United States Patent [19]

Parker et al.

[11] Patent Number: 4,706,899

[45] Date of Patent: Nov. 17, 1987

[54] GRANULATOR WITH CUTTING TONGUE ROTOR KNIFE

[76] Inventors: Frank Parker; Leslie M. Parker, both of Old Brandon Rd., Hillsboro, Tex. 76645

[21] Appl. No.: 201,041

[22] Filed: Oct. 27, 1980

[51] Int. Cl.[4] ..... B02C 18/06

[52] U.S. Cl. ..... 241/73; 241/242; 241/300

[58] Field of Search ..... 241/73, 222, 224, 242, 241/294, 300, 295, 241

[56] References Cited

U.S. PATENT DOCUMENTS

| | | | |
|---|---|---|---|
| 926,305 | 6/1909 | Utz | 241/241 |
| 2,431,294 | 11/1947 | Dulmage | 241/295 |
| 3,126,931 | 3/1964 | Blanshine et al. | 241/222 X |
| 3,321,145 | 5/1967 | Gorman | 241/300 X |
| 3,957,211 | 5/1976 | Nakamura et al. | 241/73 |

*Primary Examiner*—Timothy V. Eley
*Attorney, Agent, or Firm*—James E. Bradley

[57] ABSTRACT

A granulator for comminuting scrap material has an improved rotor blade assembly. The granulator is of the type having a pair of spaced-apart, parallel bed knives mounted stationarily in the granulator. An arcuate perforated screen is mounted below the bed knives for the passage of comminuted material through apertures in the screen. A rotor axle is mounted between and parallel with the bed knives. At least one blade is mounted on the axle for rotation with the axle. The blade has a peripheral contour with a plurality of spaced-apart cutting tongues extending outward. The cutting tongues define a circular path closely spaced to the bed knives and screen for shearing scrap.

2 Claims, 3 Drawing Figures

GRANULATOR WITH CUTTING TONGUE ROTOR KNIFE

BACKGROUND OF THE INVENTION

This invention relates in general to devices for comminuting scrap material, and in particular to the rotor knives for such a device.

In U.S. Pat. No. 4,161,296 a granulator for comminuting scrap materials is shown. The scrap material is cut into particles by a set of rotor knives that rotate past stationary bed knives. The rotor knives are parallel flat blades secured together in a cylindrical array. A perforated screen below the rotor knives allows the scrap material to pass through for collection after it has been cut to a desired size.

One difficulty with this type of granulator is that the granulator requires a large electric motor to rotate the rotor knives. To conserve energy, it would be desirable to reduce the power requirement. Another problem occurs when the blades are resharpened. As the forward edge is ground back, the space between the rotor blades and bed knives, and the rotor blades and perforated screen increase. This reduces the efficiency of the device.

In U.S. Pat. No. 3,845,907, a device for comminuting trash is shown. This device differs from granulators in that it uses two rotating axles spaced-apart from each other. Disk-shaped blades, mounted to each axle, intermesh with each other to shred the trash. Two types of disks are shown in FIG. 7 and 9. In the type shown in FIG. 9, three cutting tongues are spaced at the periphery of the disks for shredding the trash. The device of U.S. Pat. No. 3,845,907 does not have provisions for passing particles through apertures in a perforated screen to assure a minimum size for collection and further use. Also, the device of this patent does not have stationary bed knives.

SUMMARY OF THE INVENTION

This invention utilizes a perforated screen, a single axle rotor knife assembly, and a pair of bed knives for granulating plastic scrap. Instead of using a plurality of rotor knives mounted in a cylindrical array, a rotor knife is used that has a plurality of cutting tongues. The cutting tongues extend from the periphery of the blade and are rotated in close proximity to the stationary knives and the perforated screen for cutting the plastic scrap.

In the preferred embodiment, the rotor knife comprises a plurality of disk-shaped blades mounted to the rotor shaft. Each blade has a plurality of cutting tongues on its periphery. The blades are mounted so that no more than one cutting tongue passes a bed knife at the same time. Each cutting tongue in the preferred embodiment has an insert of hard metal. For drawing the scrap material into the cutting chamber, the periphery of each blade has a partially cylindrical region beginning at the forward end of the tip portion, a curved region immediately following the cylindrical region that is a continuous, smooth, inward spiral curvature, and a step region that curves smoothly outward in a continuous curve to the top of the tip portion. The hard metal insert is resharpened on its forward face so that clearances are unaffected.

DESCRIPTION OF THE PREFERRED EMBODIMENTS

Figure 1:
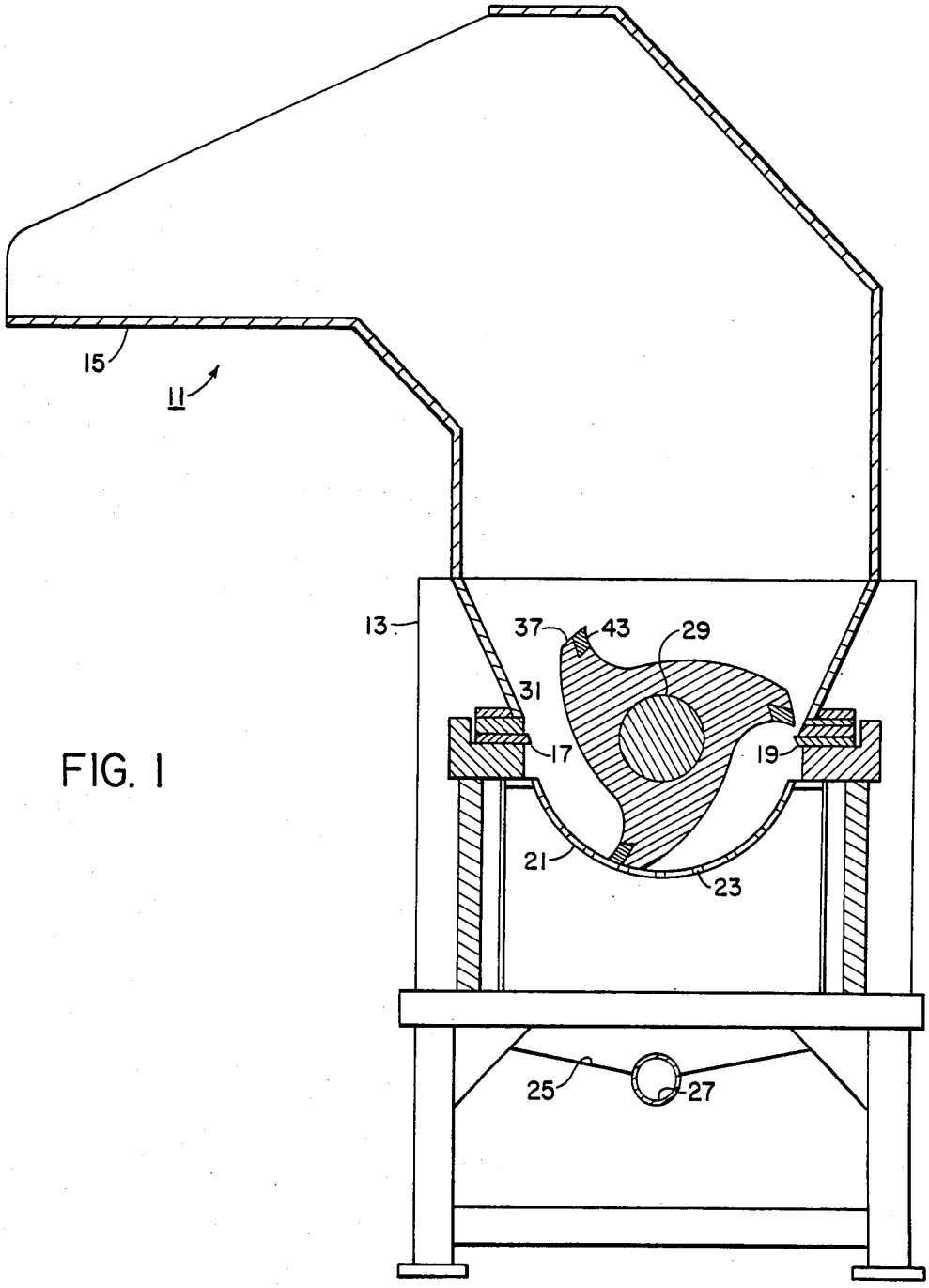
FIG. 1 is a simplified vertical cross-sectional view of a granulator constructed in accordance with this invention.

Referring to FIG. 1, granulator 11 includes a housing 13 with a chute 15 located at the top. At the bottom of chute 15, a pair of stationary bed knives 17 and 19 are mounted stationarily to the housing 13. Bed knives 17 and 19 are conventional bed knives as used with conventional granulators, each comprising an elongated flat blade, sharpened on its inner end. A semicylindrical perforated screen 21 is mounted below the bed knives 17 and 19. Screen 21 has a plurality of apertures 23 for allowing the passage of scrap particles. A collection chamber 25 is located near the bottom of housing 13. Collection chamber 25 may have a conduit 27 that leads to a vacuum source for drawing the collected particles from the collection chamber. A rotor knife axle 29 is mounted parallel with and between bed knives 17 and 19. A plurality of blades 31 are mounted to axle 29 for rotation therewith.

Figure 3:
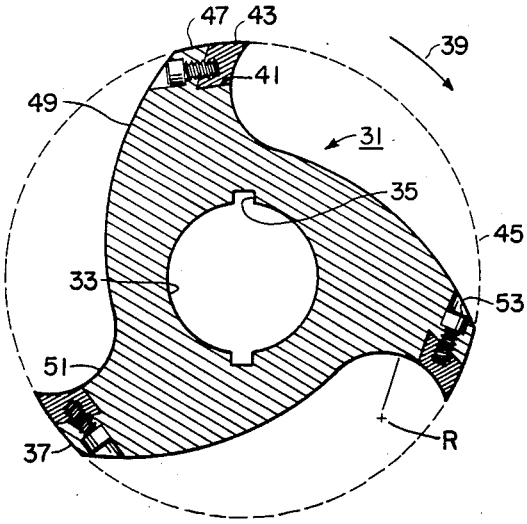
FIG. 3 is a vertical cross-sectional view of one of the cutting blades of the granulator of FIG. 1.

Referring to FIG. 3 each blade 31 has a central aperture 33 that fits closely over axle 29. Either key slots 35 in aperture 33 will mate with a key (not shown) located on axle 29 to assure that the blade 31 rotates with the axle 29. Each blade 31 has a peripheral contour that includes a plurality of cutting tongues 37, of which there are three in the preferred embodiment. The cutting tongues are equally spaced 120 degrees apart and are identical with each other. On the forward side of each cutting tongue 37, considering the direction of rotation as indicated by arrow 39, a shoulder or recess 41 is provided. Recess 41 extends in a radial direction about one-half the radial length of each cutting tongue 37. Recess 41 extends rearwardly about one-half the circumferential length of each cutting tongue 37. A hard metal tip 43 is inserted into each recess 41. The body of the blade 31 is of mild steel, while the tip 43 is of a much harder tool steel.

When blade 31 is rotated, the tops of tips 43 define a common circular path 45. Cutting tongue 37 has a portion of a cylindrical region 47 located immediately rearward of recess 41, considering the direction of rotation. Cylindrical region 47 is a curved portion with a circumferential length about one-half the total circumferential length of the cutting tongue 37, including tip 43. The cylindrical region 47 is formed at the same radius as the radius of path 45.

The rearward side of cutting tongue 37 comprises a curved region 49 immediately following cylindrical region 47. Curved region 49 is a continuous, smooth, inward spiral curvature. Curved region 49 extends radially inward to about one-half the radial length of the cutting tongue 37. The innermost radius of curved region 49 is located at the termination of the curved region and defines the minimum radius of the entire peripheral contour of blade 31. A step region 51 that defines the forward side of cutting tongue 37 immediately follows the curved region 49. Step region 51 curves smoothly outward in a continuous curve from the curved region 49 and includes the forward face of cutting tip 41, which curves at the same rate of curvature. Tip 41 is removably held in place by a screw 53 inserted through a hole formed in the curved region 49.

The radius R of the step region 51 is located between the innermost portion of curved region 49 and path 45. The sharp forward edge of tip 41 protrudes into the direction of rotation and lies in a straight line that is parallel with the axis of axle 29. Also, any straight line passed along the entire peripheral contour of blade 31 will be parallel with the axis of axle 29. The circumferential length of the curved region 49 is considerably greater than the circumferential length of the cutting tongue 37. In the preferred embodiment the rear edge of cylindrical region 47 lags the forward edge of tip 43 by about 18 degrees. The rear and innermost point of the curved region 49 lags the forward edge of tip 43 by about 110 degrees.

Figure 2:
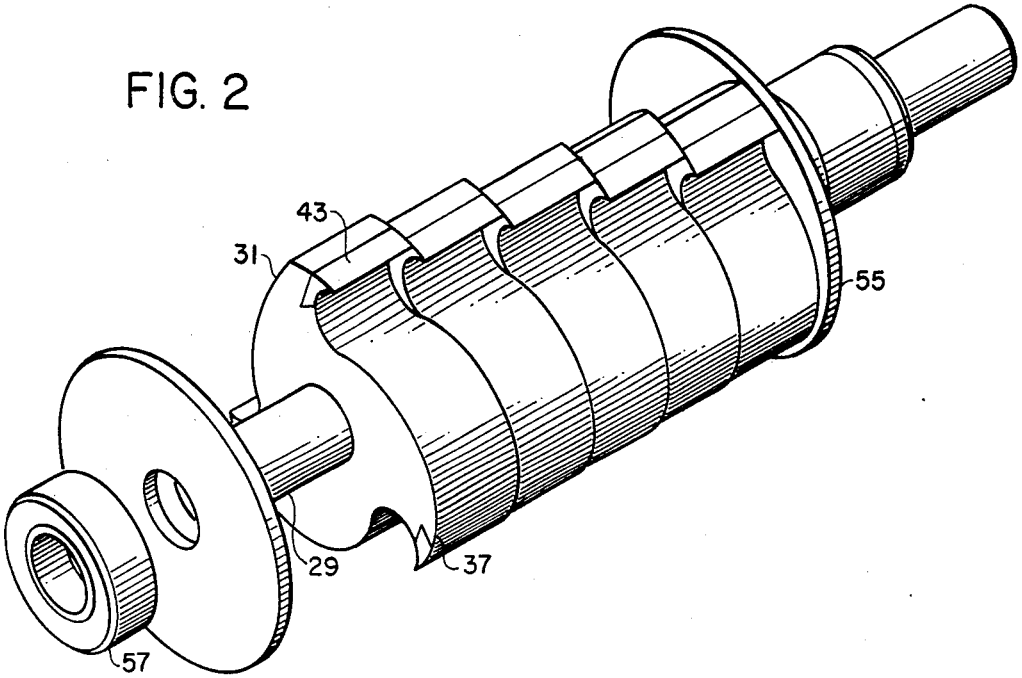
FIG. 2 is a perspective, partially exploded view of the rotor cutting blades of the granulator of FIG. 1.

In the preferred embodiment, as shown in FIG. 2, each blade 31 is disk shaped. The axial thickness of each blade 31 is less than the radius of each blade. This results in about five different blades 31 being mounted on axle 29. The slots 35 in each blade 31 are preferably formed so that each blade 31 will be staggered. When staggered, no two tips 43 will pass a bed knife 17 or 19 at the same time. In the preferred embodiment, each blade, from right to left, as shown in FIG. 2, follows the preceding blade by a few rotational degrees. Blades 31 are placed in contact with each other, with circular disks 55 being located on the outer sides of the blades 31, when assembled. Disks 55 are slightly larger in diameter than circular path 45. Bearings 57 support the assembly during rotation.

In operation, scrap material will be placed into chute 15. The scrap falls into the cutting area, where the cutting tongues 37 will grab the material and force it down between bed knives 17 and 19. When rotated, the path 45 defined by the cutting tongues 37 will place the tips 43 only a few thousandths of an inch from the bed knives 17 and 19 and the perforated screen 21. This assures good shearing action. Once the scrap material has been cut into particles smaller than the diameter of the apertures 23, they will fall through apertures 23 into the collection chamber 25 to be drawn outward through conduit 27. When the cutting tips 43 become dull, it is not necessary to remove the blades 31 for resharpening. A small hand drill can be held to the forward face of each cutting tip 43, sharpening the tip on its forward side. The tip should not be sharpened on its upper cylindrical side, since the clearances between the bed knives 17 and 19, and the cutting tongue cylindrical regions 47 should remain the same. During resharpening, a grinding wheel of radius less than the radius R may be used to avoid removing metal from step region 51. While cutting, the disks 55 prevent scrap from falling and wedging between the sides of the blades 31 and the granulator housing 13.

The invention has significant advantages. The peripheral contour and staggering of the blades provide more effficient cutting action, requiring less power. Since the forward face of each cutting tip can be resharpened, the clearances between the blades, the bed knives, and the perforated screen remain very close, allowing good shearing action. The cutting tips can be removed without removing the blades, for replacement with new tips.

While the invention has been shown in only one of its forms, it should be apparent that it is not so limited, but is susceptible to various changes and modifications without departing from the spirit of the invention.

We claim:

1. An improved granulator for comminuting scrap material, comprising in combination:

at least one bed knife mounted stationarily in the granulator;

a rotatably driven rotor axle mounted parallel with the bed knife;

a plurality of disk-shaped blades mounted in side-by-side contact with each other on the axle for rotation therewith, each blade having a peripheral contour with a plurality of spaced-apart cutting tongues extending therefrom;

each of the cutting tongues being of metal and having a tip portion in the forward portion of the tongue; and an arcuate perforated screen mounted below the blades for the passage of comminuted material; the cutting tongues, when the axle is rotated, defining a circular path closely spaced from the bed knife and screen;

the blades being staggered so that not all of the tip portions pass the bed knife at the same time;

each blade having a peripheral contour comprising:

a partially cylindrical region on the top of each cutting tongue that includes the tip portion and proceeds opposite the direction of rotation a selected circumferential distance, the cylindrical region having a radius equal to the radius of the circular path;

a curved region on the rear side of each cutting tongue immediately following the cylindrical region and comprising a continuous, smooth, inward, spiral curvature to a point of minimum radial thickness; and a step region beginning at the point of minimum radial thickness and curving smoothly outward in a continuous curve to the top of tip portion, defining the forward side of each cutting tongue.

2. An improved granulator for comminuting scrap material, comprising in combination:

at least one bed knife mounted stationarily in the granulator;

a rotatably driven rotor axle mounted parallel with the bed knife;

a plurality of disk-shaped blades mounted in side-by-side contact with each other on the axle for rotation therewith;

each blade having a plurality of space-apart cutting tongues extending therefrom; each cutting tongue being of metal and having a tip portion in the forward portion of the tongue, each tip portion having an arcuate forward face terminating in a cutting edge;

each tongue having a curved region on the outer edge of each tongue that includes the tip portion and proceeds opposite the direction of rotation, the curved region having a radius equal to the radius of the circular path;

the blades being staggered so that not all of the cutting edges pass the bed knife at the same time; and an arcuate perforated screen mounted below the blades for the passage of comminuted material.

* * * * *